US005246110A

United States Patent [19]

Greyvenstein

[11] Patent Number: 5,246,110

[45] Date of Patent: * Sep. 21, 1993

[54] REFUSE BAGS AND METHODS OF MANUFACTURE THEREOF

[76] Inventor: Lourence C. J. Greyvenstein, 150 Senior Drive, Northcliff 2195, South Africa

[ * ] Notice: The portion of the term of this patent subsequent to Jan. 2, 2007 has been disclaimed.

[21] Appl. No.: 736,978

[22] Filed: Jul. 29, 1991

Related U.S. Application Data

[60] Continuation-in-part of Ser. No. 453,950, Dec. 20, 1989, abandoned, which is a division of Ser. No. 366,309, Jun. 13, 1989, Pat. No. 4,890,736, and a continuation of Ser. No. 75,836, Jul. 20, 1987, abandoned.

[30] Foreign Application Priority Data

Jul. 15, 1986 [ZA] South Africa ..... 86/9414
Jul. 23, 1986 [ZA] South Africa ..... 86/5477

[51] Int. Cl.[5] ..... B65D 85/66
[52] U.S. Cl. ..... 206/390; 383/77
[58] Field of Search ..... 383/37, 77, 38; 206/390

[56] References Cited

U.S. PATENT DOCUMENTS

| | | | |
|---|---|---|---|
| 2,740,740 | 4/1956 | Binnall . | |
| 3,179,284 | 4/1965 | Valyi | 206/390 |
| 4,345,712 | 8/1982 | Gim | 206/390 |
| 3,749,237 | 7/1973 | Dorton | 206/390 |
| 3,774,838 | 11/1973 | Christie . | |
| 3,931,886 | 1/1976 | Yamauchi | 206/390 |
| 3,961,743 | 6/1976 | Hollowell . | |
| 4,445,230 | 4/1984 | Spadaro . | |
| 4,526,565 | 7/1985 | Hummel et al. . | |
| 4,571,235 | 2/1986 | Benoit . | |
| 4,605,392 | 8/1986 | Achelpohl et al. . | |
| 4,655,347 | 4/1987 | Horn | 206/390 |
| 4,677,697 | 7/1987 | Hayes | 206/390 |
| 4,798,572 | 1/1989 | LaFleur et al. . | |
| 4,863,285 | 9/1989 | Claxton | 383/37 |
| 4,890,736 | 1/1990 | Greyvenstein | 383/37 |
| 4,938,608 | 7/1990 | Espinosa | 383/38 |
| 5,041,317 | 8/1991 | Greyvenstein | 383/37 |

FOREIGN PATENT DOCUMENTS

| | | | |
|---|---|---|---|
| 1182787 | 2/1985 | Canada . | |
| 1496589 | 9/1967 | France | 383/37 |
| 1366440 | 9/1974 | United Kingdom . | |
| 2203127 | 10/1988 | United Kingdom . | |

OTHER PUBLICATIONS

Yoshimitsu, Japanese Utility Model Publication No. 47-30024, Sep. 8, 1972.

*Primary Examiner*—Allan N. Shoap
*Assistant Examiner*—Christopher McDonald
*Attorney, Agent, or Firm*—Cushman, Darby & Cushman

[57] ABSTRACT

A refuse bag joined at three straight sides and an open fourth side which includes projecting tie parts that can be readily tied by hand. The tie parts are each rounded peaks separated by convex valleys. Each peak has side portions and a top which has a convex part including convex transitional portions connected to the side portions which otherwise connect to the valleys. Preferably, the peaks and valleys form a sinusoid.

14 Claims, 5 Drawing Sheets

REFUSE BAGS AND METHODS OF MANUFACTURE THEREOF

Figure 1:
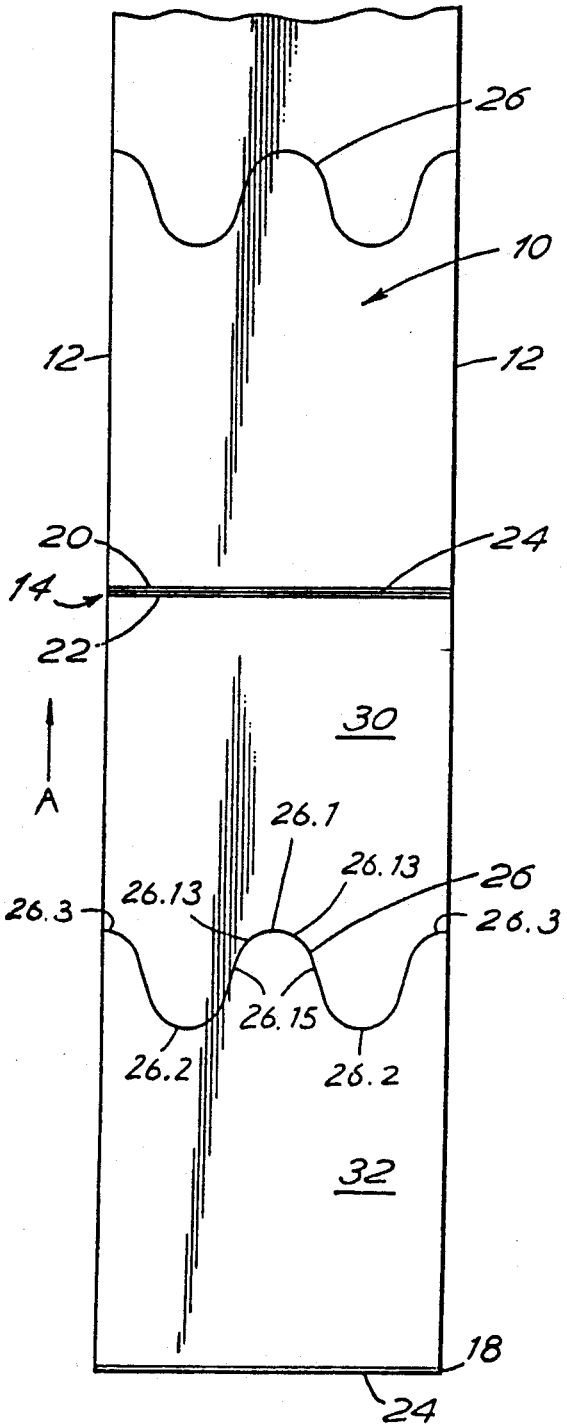

This application is a continuation in part of my application Ser. No. 07/453,950 filed Dec., 20, 1989, now abandoned, and which was divided from my application Ser. No. 07/366,309 filed Jun., 13, 1989 now U.S. Pat. No. 4,890,136 and was a continuation of my application Ser. No. 07/075,836 filed Jul., 20, 1987 now abandoned.

This invention relates to refuse bags.

The invention is concerned with a bag of the kind used for storing and or transporting material such as garbage or refuse prior to collection for or transport to disposal. Such bags are formed from plastics material and comprise, in the flat condition, two rectangular panels which are not connected along only one and, so that there is an opening through which matter can be inserted into the bag. The bag is normally made from a tubular extrusion. Such a bag is hereinafter called "a bag of the kind set forth".

Bags of the kind set forth are popular and are widely used especially for preparing kitchen refuse for collection by municipal garbage collectors. A problem that is often encountered with such bags is that it is often difficult to close them especially when substantially full. As a consequence there is usually some spillage. Furthermore dogs can become aware of the contents and will destroy the bags while trying to reach the contents. In an attempt to close these bags these are often tied at the corners which reduces the capacity of the bags.

These bags are normally made from extruded tube from which the bags are parted. Attempts have been made to modify the shape of the bags so that they have projections or tie parts which will facilitate the closing of the open end. For example in U.S. Pat. No. 3,774,838 there is shown an arrangement wherein a large cut-out is provided near one end with a joint cut to that end. This arrangement provides a pair of tie parts but it greatly reduces the capacity of the bag. In U.S. Pat. Nos. 3,961,743 and 4,445,230 there are shown arrangements wherein the parting is shaped so that a pair of projecting the parts or tails are formed that can be so tied. With two such tie parts the closure is not as satisfactory as with four tie parts. U.S. Pat. No. 4,345,712 shows an arrangement wherein four projections or tie parts are provided. In the latter three arrangements, the base of a bag has a shape corresponding to the shape of the open end of the adjacent bag and in all the arrangements shown in these specifications the bags are gusseted which has the effect of reducing the capacity of the bag for the amount of plastic material used in forming the bag.

U.S. Pat. No. 3,931,886 shows a liner for a baby's feeder bottle which is formed from an extruded tube of plastics material. This liner is provided with end portions which can be folded over the mouth of a nursing bottle whereby the bag can be fastened to the mouth of the bottle by a nipple holding ring. This bag is of a different order of size to the refuse or garbage collection bag. The crests are very small and are difficult to handle save for the purpose for which they are designed.

SHORT DESCRIPTION OF THE INVENTION

According to one aspect of the invention there is provided a refuse bag which has front and rear panels joined to each other along three straight sides. The fourth side is open and includes spaced, projecting tie parts in the front and rear panels for closing the fourth side by the ready tying of the tie parts together by hand. The tie parts are each rounded peaks separated by concave valleys with each peak having side portions and a to which has a convex part including convex transitional portions respectively connected to the side portions at one end thereof. The opposite end of the side portions is connected to a respective valley.

According to a further aspect of the invention there is provided also a roll of such bags.

Embodiments of the invention will now be described by way of example with reference to the accompanying drawings.

SHORT DESCRIPTION OF DRAWINGS

Figure 2:
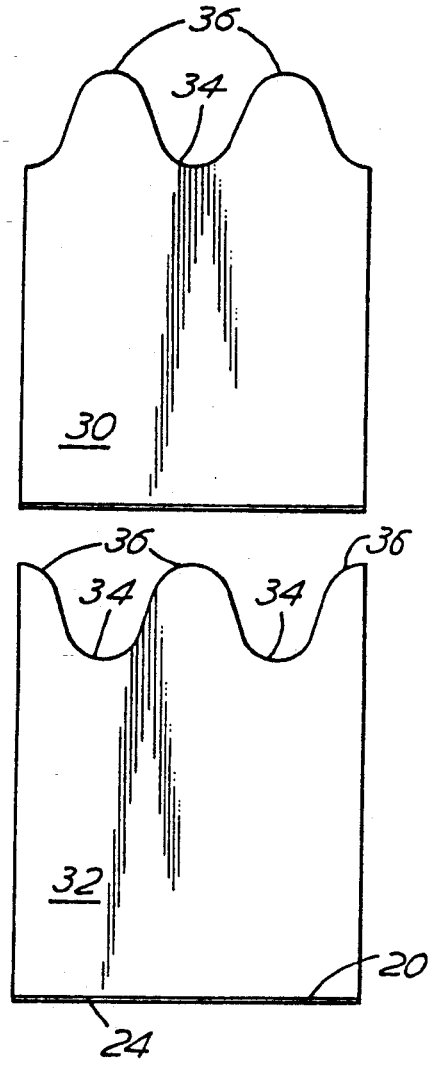
Figure 3:
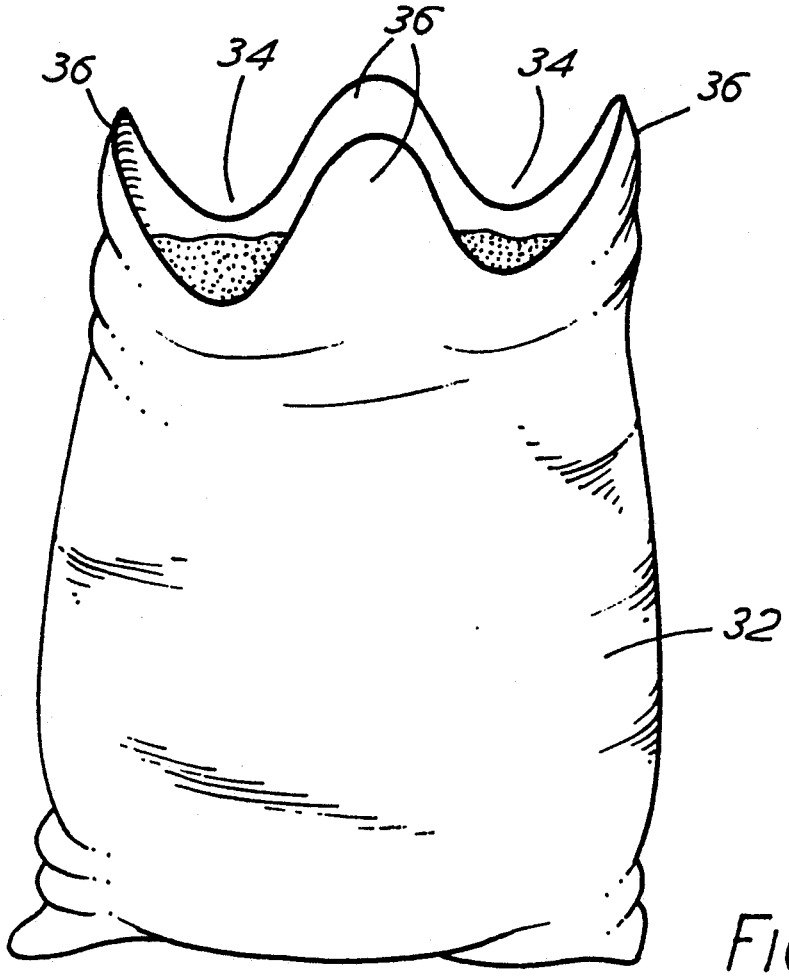
Figure 4:
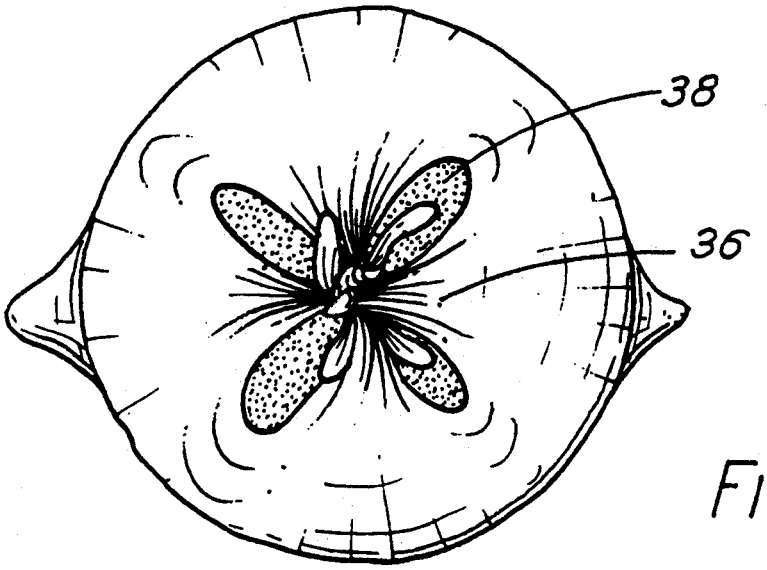
Figure 5:
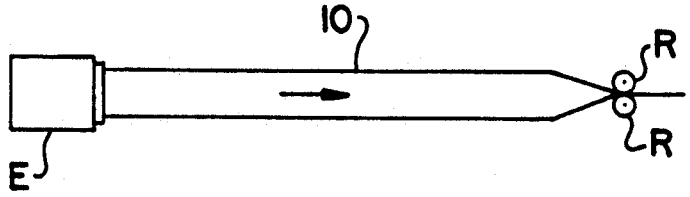
Figure 6:
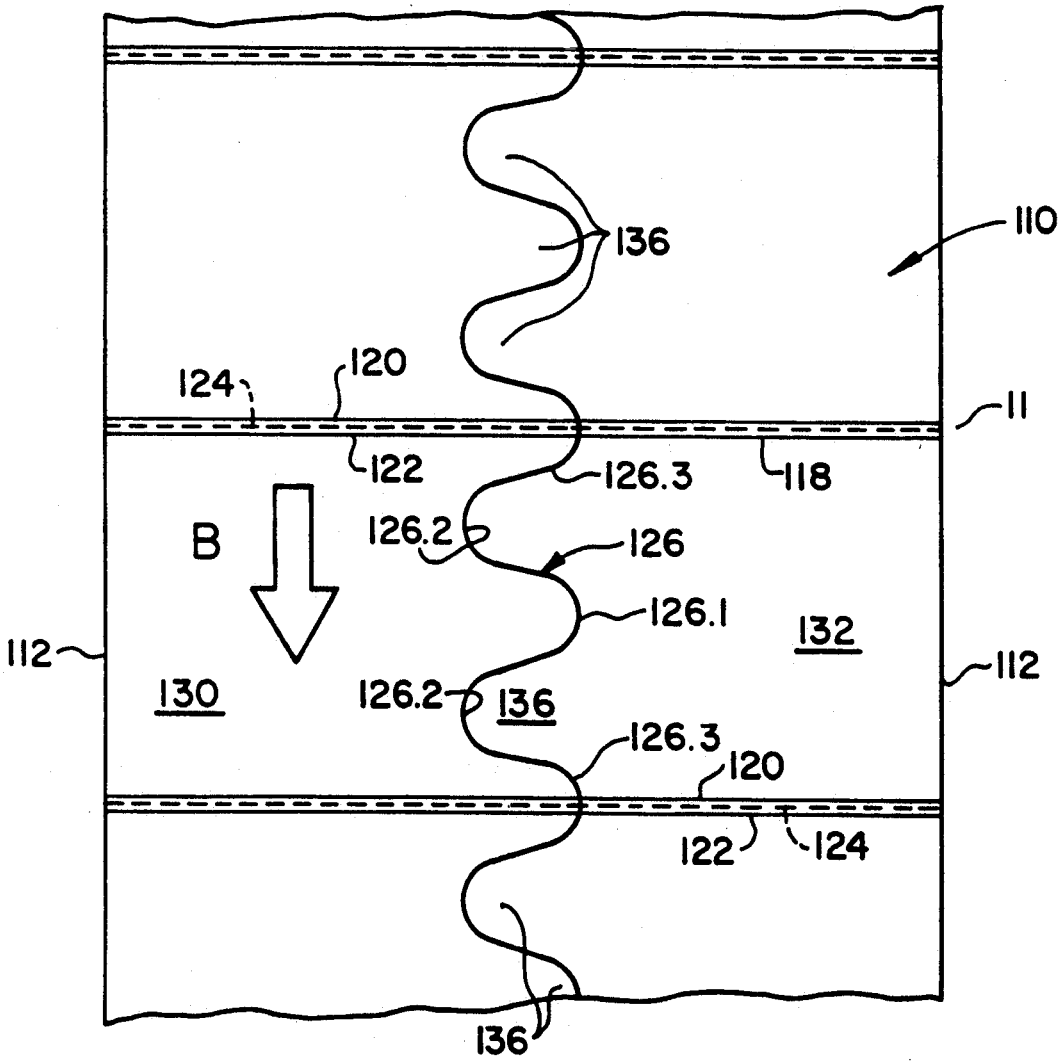

FIG. 1 shows an extruded tube that has been laid flat immediately prior to separation of the bags, FIG. 2 is a side view of two bags formed from the tube, FIG. 3 is a perspective view from the side of a bag when filled but not yet closed, FIG. 4 is a top view of the bag when filled and closed, FIG. 5 is a diagramatic view showing the extrusion of the tube and its formation into a lay flat form, FIG. 6 is a view similar to FIG. 1 of a modified embodiment of the invention, and FIGS. 7, 8, 9 and 10 are views similar to FIG. 1 of further modification of the invention shown to smaller scales.

DESCRIPTION OF FIRST EMBODIMENT

Referring now to FIG. 1 there is shown an extruded tube 10 of plastics material which is produced by an extruder E (see FIG. 5). The tube 10 is arranged in lay-flat form i.e. with front and rest panels joined along their edges 12 (without any gussets being formed) by conventional means such as rollers R. The tube 10 is processed in welding and cutting apparatus (not shown) which provides the welds and cuts as will be described. A straight transverse end weld 14 (that welds the front and rear panels of the material together) is provided transversely to the direction of extrusion "A" at suitably spaced locations 16 and 18. The end weld 14 comprises a pair of spaced parallel welds 20 and 22. A transverse end cut 24 is made between the two welds 20 and 22 to form the two bags. It will be seen that in the flat condition the bags comprise two rectangular panels joined directly at their edges 12 and at the end walls 14.

The apparatus also makes a separating cut 26 which will form the open ends 28 for each of the two bags that are formed between a pair of end cuts 24. The separation cut 26 is located midway between the end cuts 24 and is generally sinusoidal having a rounded peak including a convex central crest 26.1 and two side portions 26.15 connected at one end to crest 26.1 by respective convex transitional portions 26.13 and at their other end to respective concave valleys 26.2 on either side of the crest 26.1 and two half crests 26.3 outside the valleys 26.2. Therefore in each of the bags 30 and 32 that are thus formed cut-outs 34 to leave projecting tie parts 36 in the other bag which tie parts 36 are capable of being tied together by hand to close the opening as will be described.

It will be seen that the two bags 30 and 32 have open ends which when the bags are in the lay-flat condition appear to be of different appearance. However once these ends are open, they will be of the same shape each with four cut-outs 34 and four projecting tie parts 36. The cut-outs 34 and tie parts 36 are all identical.

When the bag 10 is filled with refuse (as shown in FIG. 3), the diametrically opposite projecting tie parts 36 can be tied together to provide a substantially complete closure for the opening to the bag 10. (In the FIG. 4, there are shown openings 38 between the tie parts 36. This is for the purpose of clarity only and in flat these openings will be very small indeed.)

I have found that this closure is more than adequate for the normal purposes to which the bag 10 is put in domestic circumstances.

DESCRIPTION OF SECOND EMBODIMENT

Referring now to FIG. 6 there is shown an extruded tube 110 of plastics material which is arranged in lay-flat form in the same manner as tube 10 and has its front and rear panels joined along their edges 112. The tube 110 is processed in welding and cutting apparatus (not shown) which provides the welds and cuts as will be described.

At spaced locations along the length of the lay-flat tube there are provided pairs of closely spaced straight transverse end weld sets 118 that weld the front and rear panels of the material together. Each weld set 118 extends from one edge 112 of the tube to the other at right angles to the direction of extrusion "B". Each end well set 118 comprises a pair of closely spaced parallel welds 120 and 122. A transverse end cut 124 is made between the two welds 120 and 122 to form the two bags 130 and 132. It will be seen that in the flat condition there are separate units comprising two rectangular panels joined at the edges 112 and at the end welds 124.

The apparatus also makes a separating cut 126 which will form the open ends for each of the two bags that are formed at each unit. The separating cut 126 is located mid-way between the edges 112 and is generally sinusoidal about an axis that extends in the direction of extrusion "B" of the tube. Between two adjacent end weld sets, the cut forms a central crest 126.1, two valleys 126.2 on either side of the crest 126.1 and two half crests 126.3 outside the valleys 126.2. Therefore in each of the bags 130 and 132 that are thus formed there are cut outs that leaves interleaves complementary projecting tie parts 136 in the other bag. These tie parts 136 are of sufficient size and shape as to be capable of being tied together by hand to close the opening as will be described.

It will be seen that the two bags 130 and 132 have open ends which when the bags are in the lay-flat condition seen to be of different appearance. However once these ends are open, the bags will be of the same shape, each with four cut-outs and four projecting tie parts 136. The tie parts 136 are all identical. The sides of the bags 130 and 132 adjacent the open ends are not gusseted. Nor are gussets formed at the bases of the bags.

When the bag 110 is filled with refuse the diametrically opposite projecting tie parts 136 can be tied together by hand to provide a substantially complete closure for the opening to the bag 110. The parts take the positions substantially identical to those shown in FIGS. 3 and 4.

DESCRIPTION OF THIRD EMBODIMENT

Figure 7:
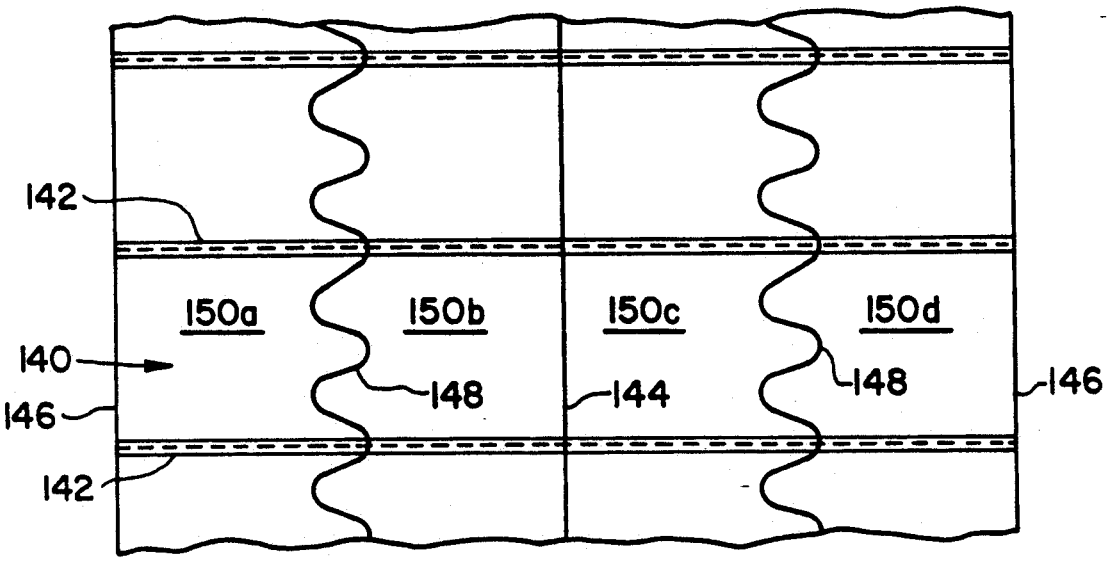

Reference is now made to FIG. 7. A plastic extruded tube 140 of greater width than tube 110 is in lay flat form. As in the FIG. 6 embodiment there are spaced straight transverse weld sets 142 extending from edge to edge across the tube. In addition there is a longitudinal weld 144 provided midway between the edges 146 of the tube 140. Separating cuts 148 are formed between the longitudinal weld 144 and the edges 146. Thus bags **150*a*, 150*b*, 150*c* and 150*d* are formed having their bases formed by the end welds 142 and their sides constituted by the edge of the tube 140 and the longitudinal weld 144**.

DESCRIPTION OF FOURTH EMBODIMENT

Figure 8:
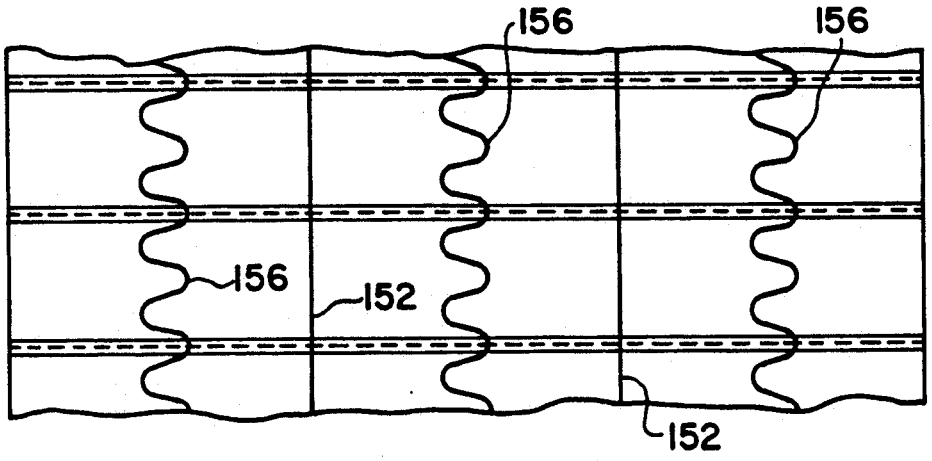

In another modification as shown in FIG. 8 there are two longitudinal welds 152 on the lay flat tube 154. Separating cuts 156 are formed between the longitudinal welds 152 and the edges of the tube 162. Thus from each unit i.e. the panels between two end weld sets 164, the number of bags formed is twice the sum of the longitudinal welds plus one.

DESCRIPTION OF FIFTH EMBODIMENT

Figure 9:
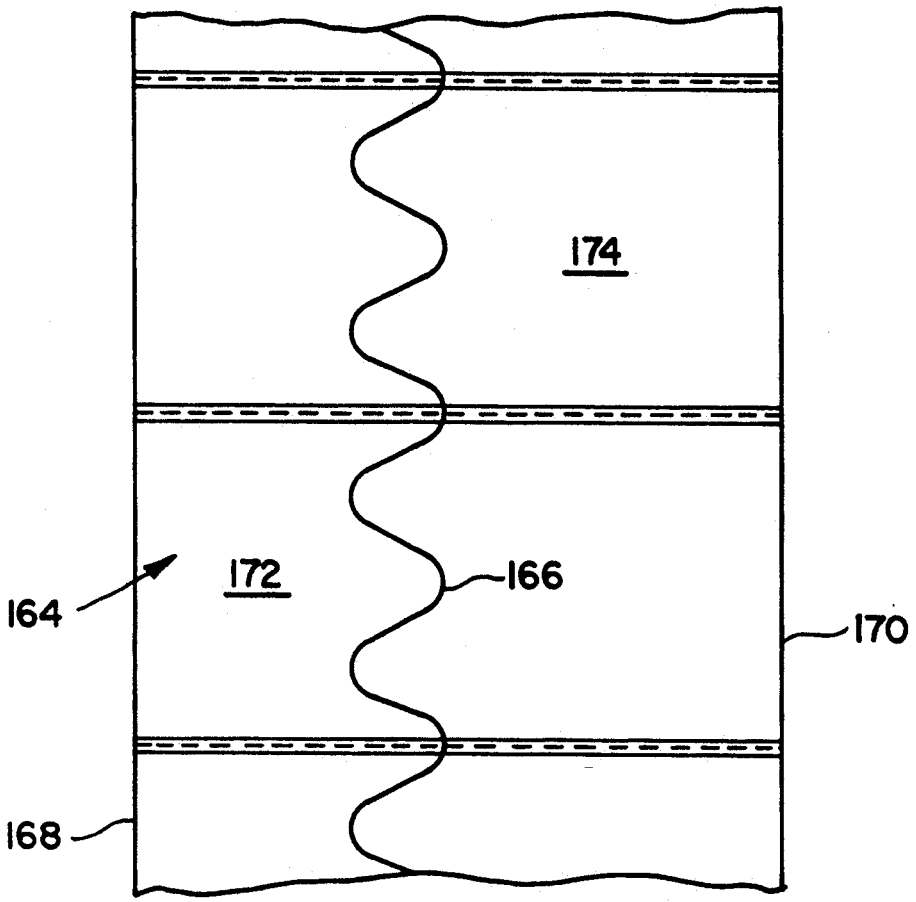

The modification as shown in FIG. 9 shows a lay flat tube 164 that is substantially the same as the tube 110 of the embodiment of FIG. 6 save that the separating cut 166 is formed closer to one edge 168 of the tube 164 than the other 170. Thus bags 172 and 174 of different capacities are formed in a single run. This is a feature of considerable importance to medium and small size producers.

DESCRIPTION OF SIXTH EMBODIMENT

Figure 10:
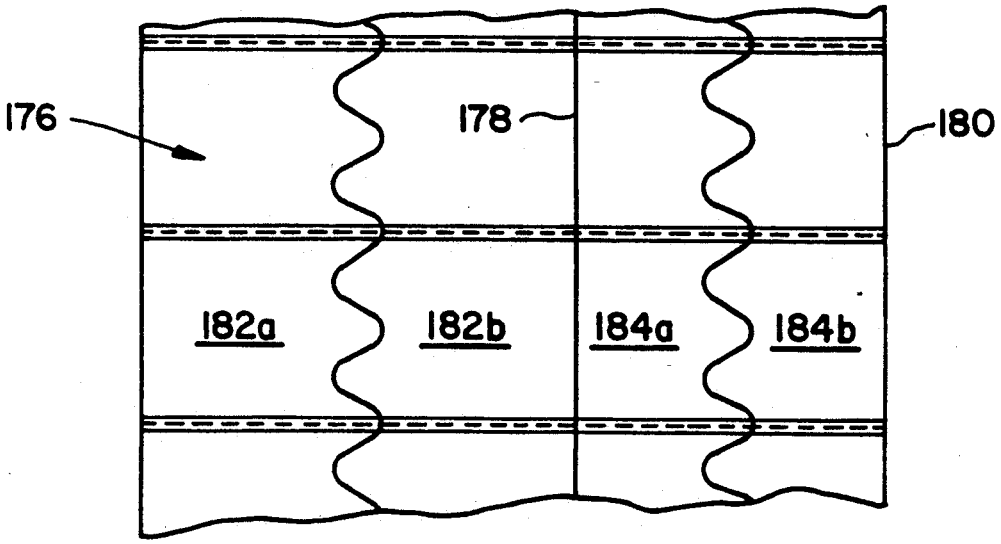

In FIG. 10 there is shown a lay flat tube 176 which is substantially similar to the tube 140 of the embodiment of FIG. 7 save that the longitudinal weld 178 is located closer to one edge 180 of the tube 176 than the other. Thus again bags **182*a* and 182*b* on the one hand and 184*a* and 184*b*** are formed of different capacities in a single run.

It will be appreciated that by moving the location of the separating cuts bags of further sizes can be produced in a single run.

The modifications herein described can be applied to the embodiment of FIG. 8.

GENERAL

The bags are of an appropriate size for use to be filled with refuse, in particular garden refuse, and household garbage. Thus typically (a) in the FIGS. 1 to 4 bag the distance between the end welds 14 is about two meters and the tube in its lay flat condition is about seven hundred and fifty millimeters and (b) in the FIG. 6 bag, the distance between the end weld sets 116 is conveniently about 750 mm and the length between the edges 112 when the tube is in the lay flat condition is about two meters. Put another way, the bags may have a nominal capacity of about thirty gallons. The smaller bags as described above would desirably be for internal household use and may have a nominal capacity of about fifteen gallons. However the dimensions may vary within this order of size i.e. the bags may typically range in capacity from say fifteen to forty gallons.

In this specification I have used the term "cut" in a broad sense with the intention that it covers both (a) a parting cut which parts one item from another and (b) a perforation cut which provides a line of weakness that permits the items to be parted from one another conveniently by tearing or pulling. Thus the bags can either be provided as separate items or as separable parts of an elongated roll of material which can be parted there-from either in a commercial outlet or in the home when required.

It will be seen that by making the bags as described above a considerable amount of material is saved in addition to providing bags which are convenient to use for tieing the tie parts to close the open ends. This is because with conventional bags only a portion can be filled if material is to be left to form ties. The upper limit of such filling is normally no more than a position slightly lower than the valleys of the cut-outs 34 and 134. Furthermore by having a straight base formed either by the straight end weld or the fold, the bag is capable of being filled to the maximum amount. Thus for forming bags of the invention of the same practical capacity as conventional bags, up to 10% (ten percent) of the bag forming material may be saved.

The invention is not limited to the precise constructional details hereinbefore described and illustrated. For example the bags may have more projections and cut-outs. The shape of the projections and cut-outs may vary as desired. These are preferably shapes with rounded corners but they may be zig-zag or rectangular in shape preferably with suitable means being provided to prevent tearing at the corners. The bags may be formed in pairs joined at perforation cuts at either the open or the closed end. There may be still more longitudinal welds provided that the tube is of sufficient size.

The bags may also be used for other storage and transport purposes such as carrier bags as used in shops and supermarkets. The sizes of the bags may vary in dependance upon the task to which the bags are to be put.

The bags may be gussetted if desired (e.g. the bases of the bags 130 and 132 may be gussetted) even though this will reduce the capacity of the bag as compared to that described above. However the provision of the straight closed end and the interleaved cut-outs and tie parts results in the bag having a larger capacity than the known gussetted bags mentioned above.

The currently preferred plastics materials are high density or low density polyethylene or polypropylene. Other plastics materials may be used as are appreciated by those skilled in the art.

The presently preferred embodiments have been given for the purpose of disclosure. However changes therein and modifications thereto can be made which are within the spirit and scope of the invention as defined by the following claims.

I claim:

1. A refuse bag used for storing and/or for transporting material such as garbage or refuse prior to collection or transport to disposal, comprising:

front and rear panels joined to each other along three straight sides and being open on the fourth side, and projection means including projecting spaced tie parts in the fourth side of each of said front and rear panels for closing said fourth open side by readily tying said tie parts together by hand, said tie parts being respective rounded peaks separated by concave valleys, each peak having side portions and a top having a convex part which includes convex transitional portions respectively connected to said side portions at one end of said side portions, an opposite end of said side portions being connected to a respective said valley.

2. A refuse bag as claimed in claim 1 wherein the said fourth side is shaped in the form of a part of a sinusoidal wave.

3. A refuse bag as claimed in claim 1 wherein the side of the bag opposite to said fourth side is constituted by a weld.

4. A refuse bag as claimed in claim 1 wherein each of the sides of the bag adjacent to said fourth side is constituted by a weld.

5. A refuse bag as claimed in claim 1 in which the front and rear panels are connected without the interposition of gussets.

6. A refuse bag as claimed in claim 1 wherein all the closed sides of the bag are constituted by welds.

7. A refuse bag used for storing and/or for transporting matter such as garbage or refuse prior to collection or transport to disposal, comprising:

front and rear panels joined directly to each other along a pair of opposite straight sides, being joined at a third straight side between said pair of sides and being open on the fourth side, projection means including projecting spaced tie parts in the fourth side of each of said front and rear panels for closing said fourth open side by readily tying said tie parts together by hand, said tie parts being respective rounded peaks separated by concave valleys, each peak having side portions and a top having a convex part which includes convex transitional portions respectively connected to said side portions at one end of said side portions, an opposite end of said side portions being connected to a respective said valley.

8. A refuse bag as claimed in claim 7 wherein the said fourth side is shaped in the form of a part of a sinusoidal wave.

9. A refuse bag as in any one of claims 1, 7 and 2 to 5 wherein said tie-parts are tied together.

10. A roll of tubular plastics material from which is formed a plurality of refuse bags for storing and/or transporting matter such as garbage or refuse prior to collection or transport to disposal comprising:

(a) front and rear panels of said plastics material;

(b) straight end welds that weld the panels together at suitably spaced locations, transversely to the direction of the materials;

(c) a straight cut adjacent to each weld, and (d) a separating cut forming an open end for two refuse bags between a pair of end welds, the said separating cut forming for each said bag on opposite sides of said separating cut projecting means including spaced projecting tie parts in the front and rear panels for closing said open end of a bag removed from the roll by readily tying said tie parts by hand, said tie parts being respective rounded peaks separated by concave valleys, each peak having side portions and a top having a convex part which includes convex transitional portions respectively connected to said side portions at one end of said side portions, an opposite end of said side portions being connected to a respective said valley.

11. A roll of tubular plastics material as claimed in claim 10 in which said panels of material are connected together directly without gussetting.

12. A roll of tubular plastics material as claimed in claim 10 in which said separating cut extends generally in the direction of the material of the roll.

13. A roll of tubular plastics material as claimed in claim 10 in which there is a longitudinal weld extending in the direction of the material, there being separating cuts extending in the direction of the material and being located respectively between the said longitudinal weld and each edge of the material.

14. A roll of tubular plastics material as claimed in claim 10 in which there is a plurality of longitudinal welds extending in the direction of the material, there being a plurality of separating cuts extending in the direction of the material and being located respectively between the said longitudinal welds and said welds and the edges of the material.

* * * * *